United States Patent [19]

Bostelmann

[11] Patent Number: 5,021,198

[45] Date of Patent: Jun. 4, 1991

[54] CARBURETOR WITH HIGH ALTITUDE COMPENSATOR

[75] Inventor: Willy Bostelmann, Wels, Austria

[73] Assignee: Bombardier Inc., Canada

[21] Appl. No.: 465,423

[22] Filed: Jan. 16, 1990

[51] Int. Cl.[5] ..... F02M 9/06

[52] U.S. Cl. ..... 261/44.3; 261/72.1; 261/DIG. 67

[58] Field of Search ..... 261/DIG. 67, 44.3, 72.1

[56] References Cited

U.S. PATENT DOCUMENTS

| | | | |
|---|---|---|---|
| 2,670,761 | 3/1954 | Fegel | 261/69.2 |
| 3,730,157 | 5/1973 | Gerhold | 261/DIG. 67 |
| 3,810,606 | 5/1974 | Masaki | 261/39.2 |
| 3,831,910 | 8/1974 | Shadbolt . | |
| 3,968,189 | 7/1976 | Bier | 261/DIG. 67 |
| 3,984,503 | 10/1976 | Gistucci | 261/DIG. 67 |
| 4,092,380 | 5/1978 | Pierlot et al. . | |

FOREIGN PATENT DOCUMENTS

| | | | |
|---|---|---|---|
| 1280617 | 10/1968 | Fed. Rep. of Germany | 261/DIG. 67 |
| 2924054 | 12/1980 | Fed. Rep. of Germany . | |
| 1422955 | 1/1976 | United Kingdom | 261/DIG. 67 |

*Primary Examiner*—Tim Miles

*Attorney, Agent, or Firm*—Larson and Taylor

[57] ABSTRACT

In order to ensure correction for altitude for the carburetor used on a internal combustion engine, a control system for the pressure within the fuel bowl (8) is incorporated. This control system consists of a pressure splitter (11) that is connected, on the one hand, with the lower pressure of the venturi throat (4) in the area in which the fuel delivery line (7) opens out and, on the other hand, with the induction pressure in the area of the inlet end (10) of the air flow passage (4), said pressure splitter incorporating a pressure line (12) with two chokes (13, 14) that are connected in series, between which the fuel bowl (8) is connected to the pressure line (12). One or both of the two chokes (13, 14) can be controlled as a function of specific air density.

5 Claims, 3 Drawing Sheets

CARBURETOR WITH HIGH ALTITUDE COMPENSATOR

BACKGROUND OF THE INVENTION a) Field of the Invention

The present invention relates to a new or improved internal combustion engine carburetor. Such carburetors typically include a level-controlled system for the fuel in the fuel bowl, and with a control system for the pressure within the fuel bowl.

b) Description of the Prior Art

In conventional carburetors, in which the pressure within the fuel bowl corresponds at least essentially to the induction pressure in the area of the inlet end of the air flow passage because of the fact that the fuel bowl is vented, the mixture ratio depends mainly on the ratio of the specific weights of air and the fuel in a given design and for a specific load. Since the specific weight, and thus air density, changes with altitude, whereas the specific gravity of the fuel does not, the mixture ratio of such a carburetor will vary as a function of altitude and the fuel/air mixture will become richer as altitude increases. In order to compensate for this enrichment, it is known that the pressure within the fuel bowl can be reduced as a function of air pressure, so that the pressure differential between the internal pressure in the fuel bowl and the reduced pressure in the venturi throat where the fuel delivery line opens out (which governs fuel flow) is reduced. A disadvantage in this known system to control the pressure within the fuel bowl by means of a barometric chamber is that it does not take into account the differential between the induction pressure in the area of the inlet end of the air flow passage and the reduced pressure in the area of the venturi throat, which changes as a function of load and engine speed and determines the throughput of air; this makes it more difficult to achieve precise correction of the mixture ratio for altitude, particularly in the partial-load range. In addition, the effects of temperature are not taken into account.

SUMMARY OF THE INVENTION

Thus, the present invention aims to avoid these shortcomings and to so improve a carburetor for an internal combustion engine, of the type described in the introduction hereto, by using simple means, that it is possible to ensure sufficiently accurate correction of the mixture ratio for altitude under all operating conditions, whilst, at the same time, taking into account the effects of temperature.

The present invention provides a carburetor for an internal combustion engine, comprising: an air flow passage that forms a venturi throat; a fuel delivery line that opens into said passage in the vicinity of said venturi throat and is connected to a fuel bowl containing fuel at a pressure controlled by a control system; wherein said control system for the pressure within the fuel bowl comprises a pressure splitter that is acted upon by the reduced pressure in the venturi throat in the area in which the fuel delivery line opens out and, also by the induction pressure in the area of the inlet end of the air flow passage; said pressure splitter incorporating a pressure line with two chokes that are connected in series, the fuel bowl being connected to said pressure line between said chokes; and wherein one or both of the two chokes is controlled as a function of specific air density.

Because of the fact that the fuel bowl is connected to a pressure splitter that is acted on both by the low pressure of the venturi throat in the area where the fuel delivery line opens out and by the induction pressure at the inlet end of the air flow passage, the pressure within the fuel bowl varies in a specific ratio with the pressure differential that determines the air throughput, this ratio being determined by the pressure splitter; this pressure differential is also present at the pressure splitter so that for a given air density there will be a constant ratio between the pressure differential that governs the air throughput and the pressure differential that exists between the fuel bowl and the outlet area of the fuel delivery line, and governs the flow of fuel. Since, however, in addition to this, one or both of the two chokes of the pressure splitter can be controlled as a function of the specific air density, the pressure within the fuel bowl can simultaneously be varied as a function of the air density such that the enrichment of the fuel mixture that results from a reduction of air density can be immediately balanced out by a corresponding reduction of the pressure within the fuel bowl. In addition, the effects of temperature are taken into account automatically by controlling the pressure splitter as a function of air density.

Preferably both of the chokes are designed to be adjustable, and in a preferred embodiment the chokes are coaxially arranged to be operated by a single profiled needle which moves in response to changes in atmospheric pressure.

In order to be able to control one of the two chokes as a function of the particular air density, and do this in a particularly simple manner, in a further development of the present invention this choke consists of a needle valve, the needle of which is connected with a diaphragm that hermetically seals an air-filled metering chamber, this diaphragm being exposed on its other side to the induction pressure at the inlet end of the air flow passage. The instantaneous volume of the metering chamber (subject to the sole condition that has to be observed, namely, that the air contained within the metering chamber is at the same temperature as ambient air) is dependent only on air density, so that the position of the needle that is connected with the diaphragm of the metering chamber is a function of air density. As a consequence, the pressure splitter can be controlled in a desired manner through the needle valve, as a function of air density.

Finally, in order that a desired relationship between the change of volume of the air within the metering chamber and the regulating distance of the needle of the needle valve can be achieved, the edge of the diaphragm can be supported on an annular profiled ring against which the diaphragm lies when acted on in an appropriate manner. Particularly simple needle profiles can be achieved by controlling the adjustment path for the needle of the needle valve in this way.

BRIEF DESCRIPTION OF THE DRAWINGS

Embodiments of the present invention are shown by way of an example in the drawing appended hereto, wherein.

DESCRIPTION OF THE PREFERRED EMBODIMENTS

Figure 1:
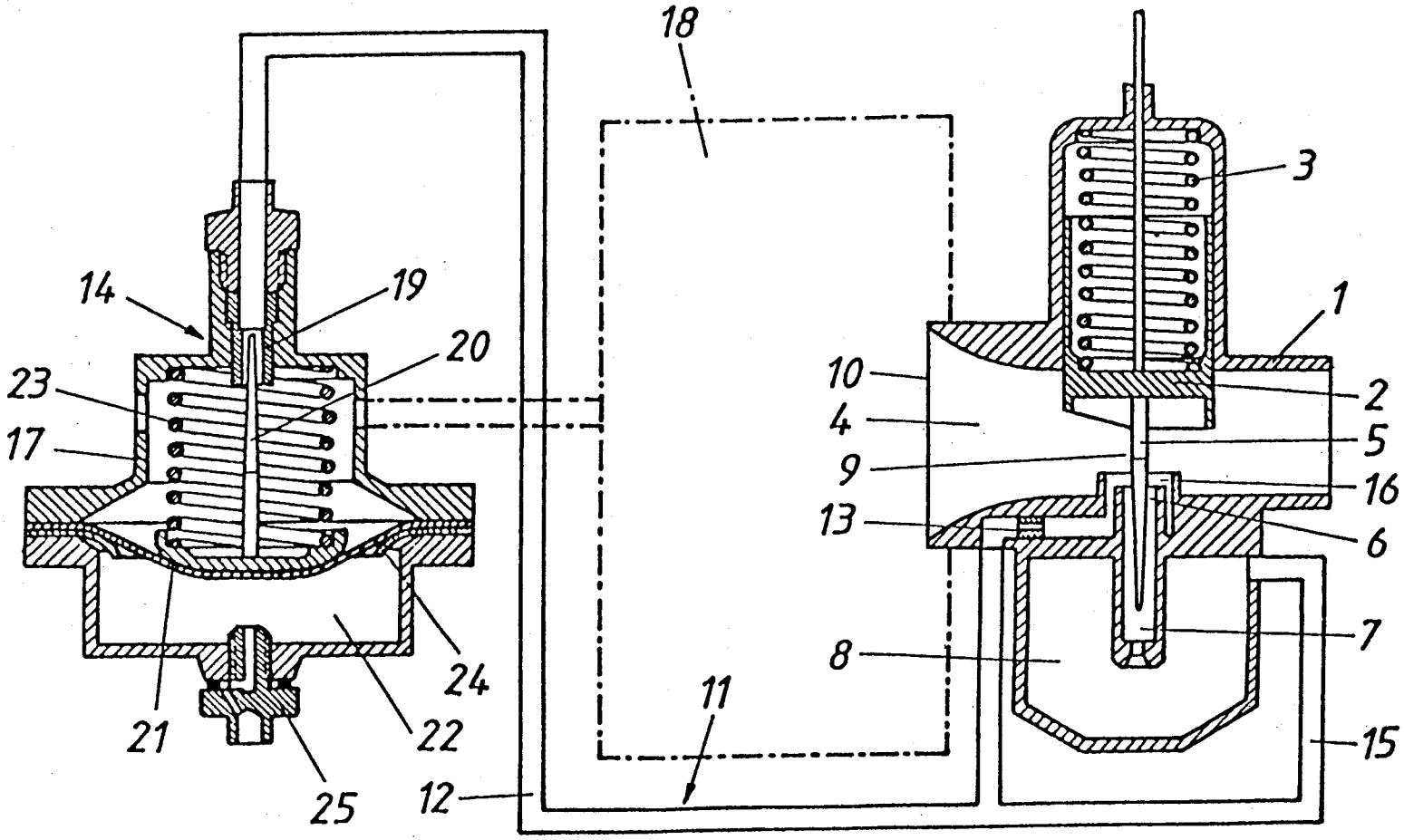
FIG. 1 shows a carburetor according to the present invention to be used for an internal combustion engine, and shown in a diagrammatic, simplified cross section.

The carburetor Cl shown in FIG. 1 is configured as a slide-valve carburetor with a housing 1 in which the throttle slide 2 is so supported as to be able to slide. This throttle slide is acted upon transversely to the longitudinal axis of the air flow passage 4 of the carburetor by a spring 3, and supports a throttle needle 5 that controls the unobstructed flow cross section of the jet orifice 6 that is incorporated in a fuel delivery line 7. This fuel delivery line 7 is connected to a fuel chamber 8 which is configured in the usual manner as a fuel bowl, in order to ensure a constant fuel level within the chamber. However, for reasons of clarity, the float and the fuel delivery line to the fuel bowl are not shown in greater detail herein.

Because of the fact that the throttle slide 2 determines the unobstructed flow cross section in the area of the throat 9 in the venturi, the amount of fuel/air mixture that is supplied to the engine and, furthermore, the composition of this mixture can be controlled as a function of the particular load. In a given design, air throughout is determined by the pressure differential between the induction pressure in the area of the inlet end 10 of the air flow passage 4 and the lower pressure in the area of the venturi throat 9. Fuel throughput depends, analogously, on the pressure differential between the pressure within the fuel bowl 8 and the lower pressure in the air flow passage 4 in the area in which the fuel delivery line 7 opens out. In order that a specific ratio between the pressure differential that determines the air throughput and the pressure differential that determines the fuel throughput can be ensured, a pressure splitter 11 is incorporated, and consists of a pressure line 12 with two chokes 13, 14 that are connected in series, between which the fuel bowl 8 is connected to the pressure line 12 through a connecting line 15. Because this pressure line 12 opens out at one end into an annular passage 16 that is open towards the throat 9 in the passage 4 and encloses the jet orifice 6 in the fuel delivery line 7, and at the other opens into a housing 17 that is connected either with the outside atmosphere or with an induction damper or intake silencer 18 (shown in broken lines) through which the air for the carburetor is drawn, this pressure splitter 11 is acted on both by the induction pressure in the area of the inlet end 10 of the passage 4, and by the lower pressure in the throat 9 in the area where the fuel delivery line 7 opens out. This means that, for the fuel bowl 8, an internal pressure will be set (through the connecting line 15) that is a function both of the induction pressure in the area of the inlet end 10 and also of the lower pressure in the area in which the fuel feed line 7 opens out, this pressure within the fuel bowl 8 resulting because of the specific pressure drops in the area of the chokes 13 and 14.

If the pressure differential within the air flow passage 4 that governs the throughput of air changes as a result of a change in the load on the engine, then the pressure within the fuel bowl 8 will be varied in the same proportion through the pressure splitter 11, so that the mixture ratio for the carburetor will remain the same.

In order to be able to take into account not only changes of the pressure differential that govern the throughput of air, but also changes in air density, in particular those caused by changing altitude, the choke 14 can be controlled as a function of the specific air pressure. To this end, this choke is configured as a needle valve 19, the needle 20 of which is connected to a diaphragm 21 that hermetically seals an air-filled metering chamber 22. This diaphragm 21 is located within the housing 17 and is acted upon, depending on the carburetor, either by atmospheric air or, if an induction damper 18 is incorporated, by the pressure within this induction damper. Provided that the temperature is the same for the air that is enclosed in the metering chamber 22 and ambient air, the volume of the air that is enclosed in the metering chamber 22, and thus the deflection of the diaphragm 21, will depend solely on air density, so that the adjustment position of the needle 20 that is held in contact with the diaphragm 21 by the spring 23 will be a measure for air density. The choke 14 that is thus controlled as a function of air density makes it possible to balance the carburetor for altitude in a very simple manner, in that as the altitude increases the pressure within the fuel bowl 8 which otherwise causes an enrichment of the fuel mixture will be reduced as a function of the air density. This reduction in density will lean out the mixture.

In order that the adjustment path of the needle path 20 in the needle valve 19 can be brought to the desired relationship with the change in the volume of air in the adjustment chamber 22, the diaphragm 21 is supported around its edges by an annular flared ring 24 so that the bending behaviour of the diaphragm 21 and thus the flexure in the region of the needle seat is effected by this ring 24. The quantity of air that is enclosed in the metering chamber 22 can be adjusted by means of the screw-type union 25.

Figure 2:
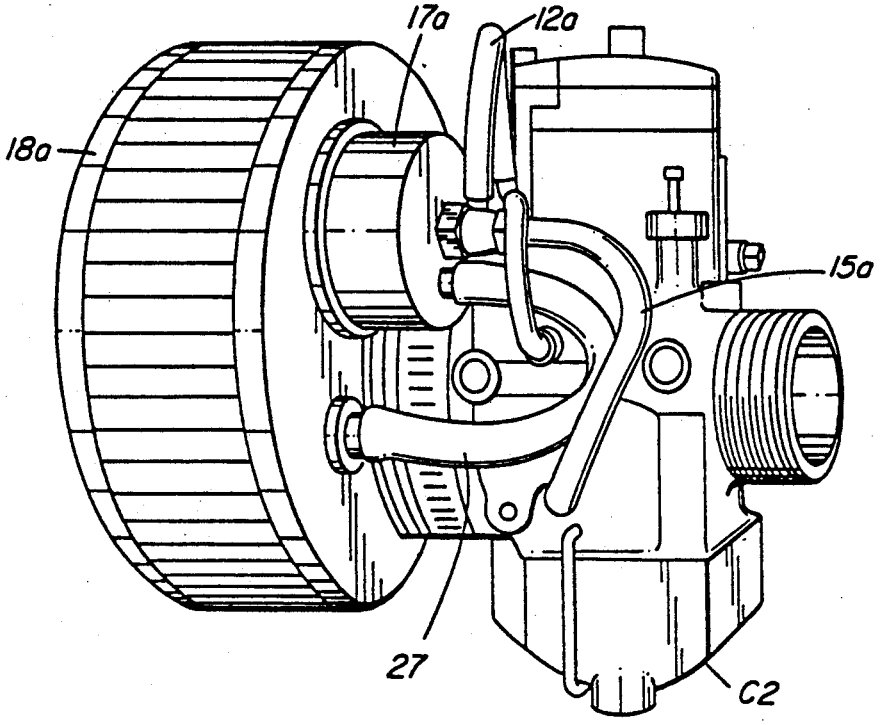
FIG. 2 is a perspective view of a carburetor and air intake silencer including a modified pressure compensating system.
Figure 4:
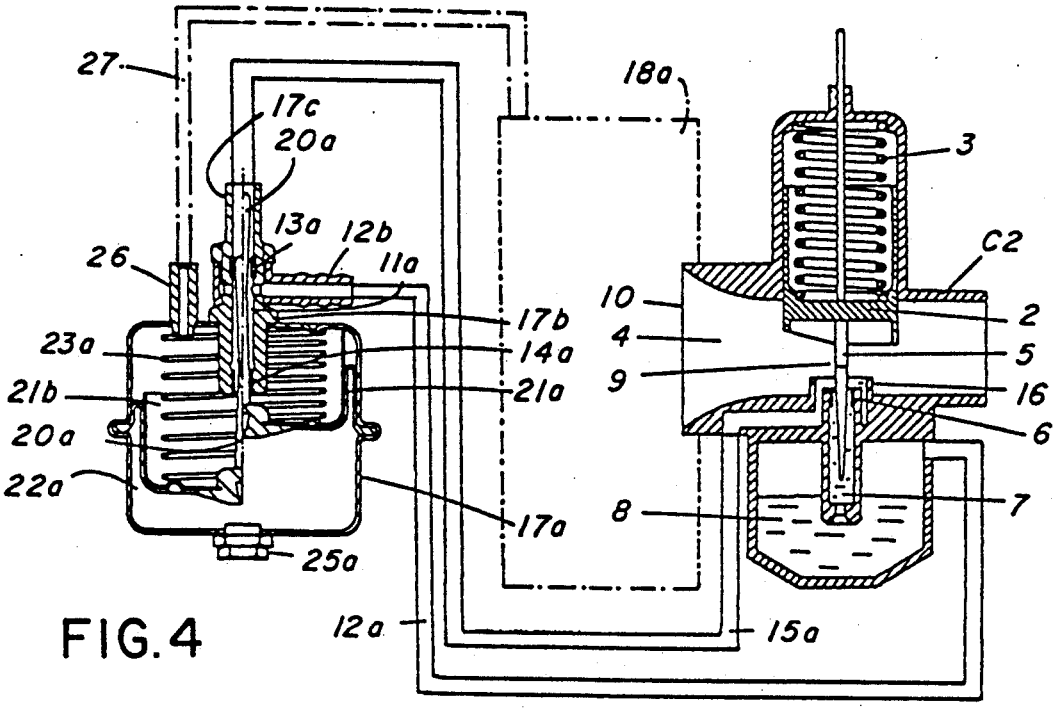
FIG. 4 is a view similar to FIG. 1 but wherein both chokes of the pressure-splitter are controlled by a single profiled needle.

In FIGS. 2 and 4, the carburetor C2 is of similar type to that shown in FIG. 1 and is illustrated as connected to an air intake silencer 18*a*. The air inlet end 10 of the carburetor communicates with the interior of the intake silencer 18*a*. A diaphragm housing 17*a* is positioned extending through the wall of the silencer, and is shown in more detail in FIG. 3 as defining a metering chamber 22*a* closed on one side by a diaphragm 21*a*, the diaphragm being shown in different positions in the right and left hand sides of FIG. 3. The diaphragm supports a cup-shaped spring seat 21*b* which is engaged by a coiled compression spring 23 surrounding an axially projecting profiled needle 20*a*. The needle 20*a* projects through a coaxial fitting 17*b* mounted in the end wall of the housing 17*a*, there being two axially spaced tubular chokes 14*a* and 13*a* positioned in the fitting for cooperation with the needle. As shown in FIG. 4, the end 17*c* of the fitting 17*b* connects through a tubular passage 15*a* to the pressure prevailing in the venturi throat area of the carburetor. The region of the bore of the fitting 17*b* between the chokes 13*a* and 14*a* constitutes a pressure splitter 11*a* which through a spigot 12*b* and a tube 12*a* connects to the fuel bowl of the carburetor C2. A spigot 26 in the end wall of the housing 17*a* communicates the interior of the housing with the pressure prevailing in the intake silencer 18*a* through a tube 27. The quantity of air within the metering chamber 21*a* can be adjusted by means of the valve 25*a*.

As is well understood, the fuel delivery rate of the carburetor C2 depends on the size of the fuel jet orifice in the carburetor and the pressure acting on the fuel. This pressure results from the pressure difference between the fuel bowl and the fuel jet orifice in the carburetor venturi throat. Pressure increase in the fuel bowl produces a richer fuel mixture whereas pressure decrease produces a leaner mixture. The arrangement disclosed produces the necessary pressure reduction in the carburetor fuel bowl to compensate for increases in altitude. The pressure splitter 11*a* acts as a pressure attenuator that is in communication with the fuel bowl through the spigot 12*b* and is also in communication with the low pressure of the carburetor venturi throat through the spigot 17*c*, and with the pressure at the inlet to the carburetor through the choke 14*a* and the spigot 26.

Figure 3:
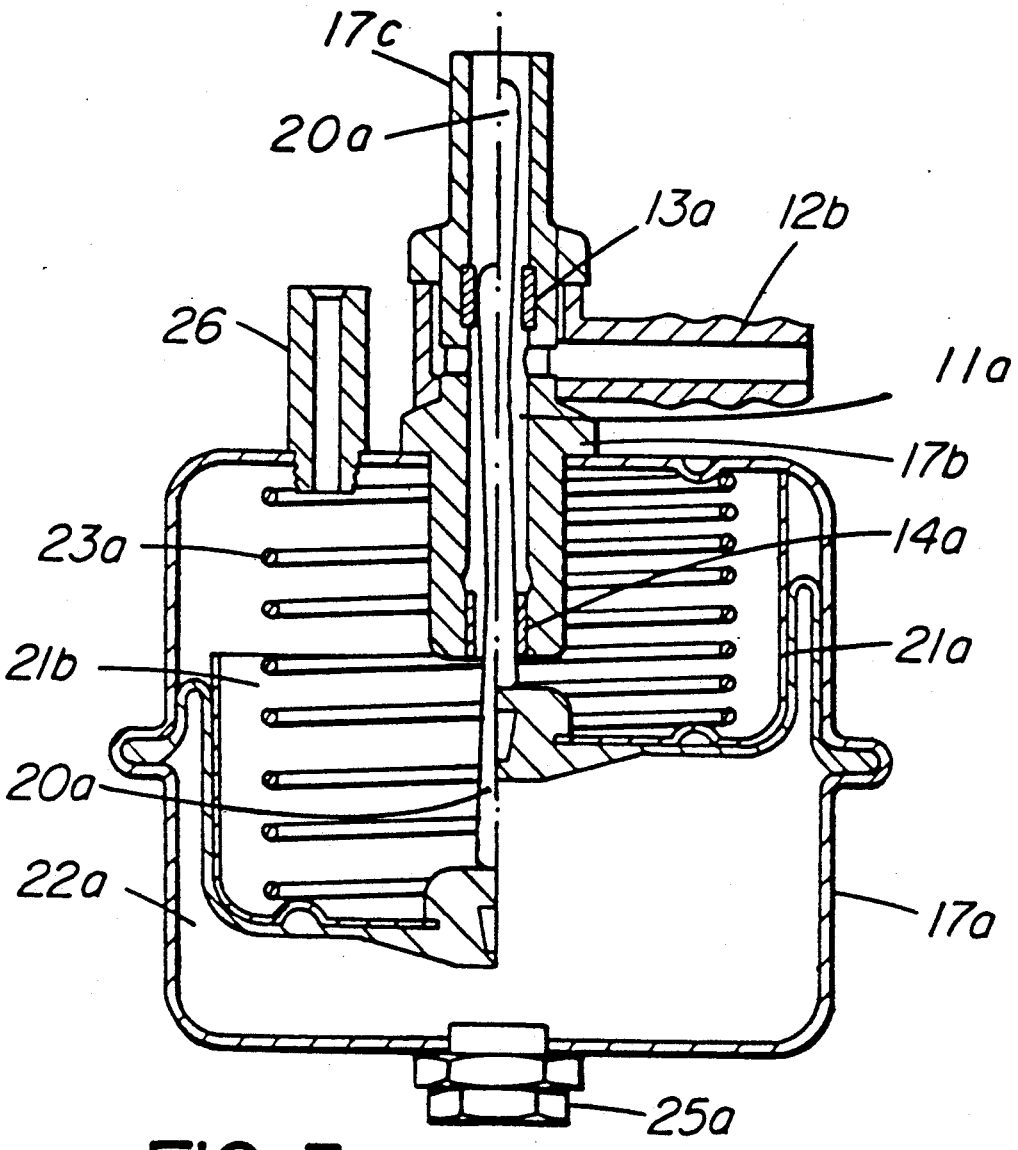
FIG. 3 is a partial sectional view of a housing included in the embodiment of FIG. 2.

The volume of the air in the metering chamber 22*a* is dependent upon the barometric pressure, and therefore at low altitude the diaphragm will be in the position as shown in the left hand side of FIG. 3, and at high altitude will be in the position as shown in the right hand side of FIG. 3, the diaphragm 21*a* rolling smoothly between the cup 21*b* and the wall of the housing 17*a* as the volume of the air in chamber 21*a* changes. As the diaphragm 21*a* moves, so does the needle 20*a*, its profile surface cooperating with the chokes 13*a* and 14*a* to restrict the area thereof to a greater or lesser degree as required. With increasing altitude the open area of the choke 13*a* increases and the open area of the choke 14*a* decreases so that the pressure in the carburetor fuel bowl decreases and the air/fuel mixture is made leaner. Thus the arrangement provides an automatic compensation of the fuel mixture in respect of changes in altitude of the vehicle in which the engine is mounted.

It is of course understood that the present invention is not restricted to the embodiments shown herein. Thus, in place of a slide-type carburetor, it is possible to use a carburetor with an air inlet of a fixed size. It does not depend on the construction of the carburetor but instead on the fact that the fuel bowl 8 is connected through a pressure splitter with the air flow passage 4, the pressure splitter incorporating two chokes that are connected in series, one or both of these being controlled as a function of air density. Furthermore, the fuel bowl 8 need not be configured as a float chamber but can rather incorporate a diaphragm that determines the level of fuel therein, and acts on the fuel in conjunction with the pressure within the fuel bowl.

What is claimed is:

1. A carburetor for an internal combustion engine, comprising:

an air flow passage that forms a venturi throat;

a fuel delivery line that opens into said passage in the vicinity of said venturi throat and is connected to a fuel bowl containing fuel at a pressure controlled by a control system;

wherein said control system for the pressure within the fuel bowl comprises a pressure splitter that is acted upon by the reduced pressure in the venturi throat in the area in which the fuel delivery line opens out and, also by the induction pressure in the area of the inlet end of the air flow passage;

said pressure splitting incorporating a pressure line with two chokes that are connected in series, the fuel bowl being connected to said pressure line between said chokes;

one of the two chokes being controlled as a function of specific air density, and consisting of a needle valve having a needle carried on a diaphragm which is exposed on one side to the pressure within a sealed air-filled metering chamber and on the other side to the induction pressure in the area of the inlet and of said air flow passage, said needle valve controlling the area of said one choke through which said pressure line is exposed to said induction pressure;

wherein said needle is of varying profile along its length and has a first section that cooperates with a first jet passage to define said one choke, and a second section that cooperates with a second jet passage to define the other said choke.

2. A carburetor as claimed in claim 1, wherein the periphery of said diaphragm is supported on a flared annular ring.

3. A carburetor as claimed in claim 1 wherein each said choke is adjustable in position by adjustment of the quantity of air in said metering chamber.

4. A carburetor as claimed in claim 1 wherein said diaphragm is mounted around its periphery to a cylindrical wall of a housing, said metering chamber being defined between said diaphragm and one end of said housing;

said needle being supported in a cup shaped spring seat that has a cylindrical skirt and is open towards the second end of said housing, and is engaged by a compression spring which also engages said second end;

said diaphragm being adapted to be rolled over between said skirt and said cylindrical wall of said housing as said spring seat and needle move in the axial direction.

5. A carburetor for an internal combustion engine, comprising:

an air flow passage that forms a venturi throat;

a fuel delivery line that opens into said passage in the vicinity of said venturi throat and is connected to a fuel bowl containing fuel at a pressure controlled by a control system;

wherein said control system for the pressure within the fuel bowl comprises a pressure splitter that is acted upon by the reduced pressure in the venturi throat in the area in which the fuel delivery line opens out and, also by the induction pressure in the area of the inlet end of the air flow passage;

said pressure splitter incorporating a pressure line with two chokes that are connected in series, the fuel bowl being connected to said pressure line between said chokes;

one of the two chokes being controlled as a function of specific air density, each said choke being adjustable in position by adjustment of the quantity of air in said metering chamber, and wherein each of said chokes is controlled by a needle carried on a diaphragm which is exposed on one side to the pressure within a sealed metering chamber and on the other side by the induction pressure in the area of the inlet end of said air flow passage, said needle being of varying profile along its length and having a first section that cooperates with a first jet passage to define said one choke and a second section that cooperates with a second jet passage to define the other choke, said needle operating to decrease the area of said first jet passage and increase the area of said second jet passage with expansion in volume of said metering chamber.

* * * * *